US005181251A

United States Patent [19]

Schultheiss et al.

[11] Patent Number: 5,181,251

[45] Date of Patent: Jan. 19, 1993

[54] AMPLIFIER UNIT

[75] Inventors: Roger Schultheiss; Paul Zwicky, both of Dielsdorf, Switzerland

[73] Assignee: Studer Revox AG, Regensdorf, Switzerland

[21] Appl. No.: 765,247

[22] Filed: Sep. 25, 1991

[30] Foreign Application Priority Data

Sep. 27, 1990 [CH] Switzerland ..... 03111/90

[51] Int. Cl.[5] ..... H04R 3/00

[52] U.S. Cl. ..... 381/96; 381/59; 381/76

[58] Field of Search ..... 381/96, 59, 76

[56] References Cited

U.S. PATENT DOCUMENTS

| | | | |
|---|---|---|---|
| 4,118,600 | 10/1978 | Stahl | 381/98 |
| 4,741,040 | 4/1988 | Kaizer | 381/96 |
| 4,969,195 | 11/1990 | Noro | 381/96 |
| 5,014,320 | 5/1991 | Nagi et al. | 381/96 |
| 5,031,500 | 7/1991 | Koike et al. | 381/96 |

FOREIGN PATENT DOCUMENTS 0322679 7/1989 European Pat. Off. .

OTHER PUBLICATIONS

International Search Report.

"Loudspeakers in Vented Boxes: Part II", by A. N. Thiele, Journal of the Audio Engineering Society, vol. 19, No. 6, Jun. 1971, pp. 192-204.

"Vented-Box Loudspeaker Systems", by Richard H. Small, Journal of the Audio Engineering Society, Jun. 1973.

"Loudspeakers in Vented Boxes", by A. N. Thiele, Journal of the Audio Engineering Society, May 1971.

*Primary Examiner*—Forester W. Isen
*Assistant Examiner*—Nina Tong
*Attorney, Agent, or Firm*—Sandler, Greenblum & Bernstein

[57] ABSTRACT

In order to obtain for electrodynamic loudspeakers, on the one hand, the energy-favorable acoustical enhancement by the bass reflex principle and, on the other hand, to be able to use the motional control of the diaphragm of the electrodynamic loudspeaker by controlling such by means of an amplifier exhibiting negative output impedance, it is proposed to compensate the thus resulting unfavorable frequency characteristic by a forwardly connected circuit which generates an inverse characteristic with respect to the unfavorable frequency characteristic.

5 Claims, 6 Drawing Sheets

AMPLIFIER UNIT

BACKGROUND OF THE INVENTION

1. Field of the Invention

The present invention relates to a new and improved amplifier unit for driving an electrodynamic loudspeaker arranged in a cabinet or box along with a device which is coupled with the loudspeaker and which adds acoustic energy in a limited frequency range with the same polarity or unipolarly to that energy which is delivered from the front of the loudspeaker.

2. Discussion of the Background and Material Information

Belonging to the foregoing are, for example, bass reflex cabinets or boxes with amplifier units serving for driving or powering the loudspeakers or loudspeaker elements arranged in the bass reflex cabinet. Normally two resonance circuits are coupled with one another in a bass reflex cabinet. The one resonance circuit is constituted by the loudspeaker and the other resonance circuit by the aforementioned coupled device which, for example, comprises a port or opening in the cabinet which is coupled by the air contained in such cabinet with the rear or back of the diaphragm of the loudspeaker. Such bass reflex cabinets or boxes normally augment the acoustics within a narrowly defined frequency range. From the Journal of the Audio Engineering Society, Volume 19, No. 6, June 1971, the article authored by A. N. Thiele, entitled: "Loudspeakers in Vented Boxes: Part II", pages 192 to 204, it is known in this technology to drive such loudspeakers by an amplifier having negative output impedance, resulting in improved adaptation of the loudspeaker to its cabinet or box and vice versa.

The drawback of this combination of bass reflex cabinet or box and amplifier resides in dimensioning difficulties. These combinations have a frequency response in the bass range whose descent towards null is of the fourth order. Consequently, they possess a poorly controllable transient oscillation behavior and an unfavorable phase response.

A further such amplifier unit for driving the voice or moving coil of a bass loudspeaker is known, for instance, from the German Patent Publication No. 2,713,023 and the cognate U.S. Pat. No. 4,118,600, granted Oct. 3, 1978. Here, the amplifier unit has an output impedance which is equivalent to a negative resistance connected in series with a parallel resonance circuit. The negative resistance has practically the same value as the resistance of the voice coil. Due to the operation of the bass loudspeaker with such type amplifier there can be obtained a change of the bass loudspeaker which is equivalent to a change in the mechanical parameters of the loudspeaker, like, for example, its mass, compliance and damping. In other words, with these measures the resonance frequency of the loudspeaker is counteracted and at the same time there is produced a different resonance frequency which is better tuned to the cabinet and the device coupled with the rear or back of the diaphragm.

This prior art amplifier unit affords improvements in the frequency response of the therewith coupled loudspeaker, which is limited to the low-frequency range. Here, there is present a system of the fourth order possessing the previously noted drawbacks. No improvements can be realized for the mid- and high-tone ranges.

In European Patent No. 0,322,679, published Jul. 5, 1989, there is disclosed a loudspeaker system where the front side of a diaphragm drives a first resonator and the rear side of such diaphragm drives a second resonator, and thus, there is not generated any sound or acoustics which act directly upon the external surroundings. In contrast to a system containing a single resonator, it is thus possible to augment the frequency range where there arises resonance and thus bass intensification or amplification. By driving such system with an amplifier exhibiting negative output impedance there can be improved the frequency response for low frequencies.

The drawback of this system resides in the fact that it only provides improvements for low frequencies and there must be provided an additional loudspeaker which radiates tones of such frequencies which upwardly merge with the resonance frequencies of the higher-frequency resonator. Furthermore, there is here involved a system of at least the fourth order which is prone to the aforementioned disadvantages.

SUMMARY OF THE INVENTION

Therefore, with the foregoing in mind, it is a primary object of the present invention to provide an improved amplifier unit which is not afflicted with the aforementioned drawbacks and limitations of the prior art.

Another and more specific object of the present invention aims at providing an improved amplifier unit which, from the bass range to the high tone range, exhibits as ideal as possible, that is, a linear frequency- and phase response without the need to forego the use of acoustical enhancement by means of a cabinet or box resonator.

Now in order to implement these and still further objects of the present invention, which will become more readily apparent as the description proceeds, the amplifier unit of the present development is manifested, among other things, by the features that the amplifier unit exhibits a negative output impedance, the loudspeaker together with the coupled device, an amplifier and an integrator delivers an output signal exhibiting a first characteristic, and the amplifier unit is provided with circuit means which alters an input signal in accordance with a second characteristic which is at least approximately inverse to the first characteristic.

Still further according to the present invention, the circuit means or circuit comprises filter means.

Moreover, according to another aspect, the amplifier exhibits a negative output impedance and is constructed such that the negative output impedance is effective at least over two octaves above the resonance frequency of the loudspeaker.

The first characteristic is determined by computation employing an equivalent circuit for the loudspeaker equipped with the cabinet or box, the coupled device and the amplifier.

According to a still further feature, the circuit means or circuit is connected in series with the integrator and the amplifier.

Certain of the more notable advantages realized with the present invention especially reside in the features that the inventive amplifier unit can be advantageously connected with a loudspeaker, installed in a cabinet or box, which comprises a Helmholtz resonator or another optional oscillatable element, as such is the case, for instance, for so-called bass reflex cabinets or boxes. By virtue of the particular construction of the amplifier unit of the present development, the advantages afforded by a negative output impedance at the amplifier unit, can be combined with the advantages afforded by, for instance, bass reflex systems.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been frequently used the same reference numerals to denote the same or analogous elements, and wherein.

DETAILED DESCRIPTION OF THE PREFERRED EMBODIMENTS

Describing now the drawings, it is to be understood that only enough of the construction of the amplifier unit and related structure have been depicted therein, in order to simplify the illustration, as needed for those skilled in the art to readily understand the underlying principles and concepts of the present invention.

Figure 1:
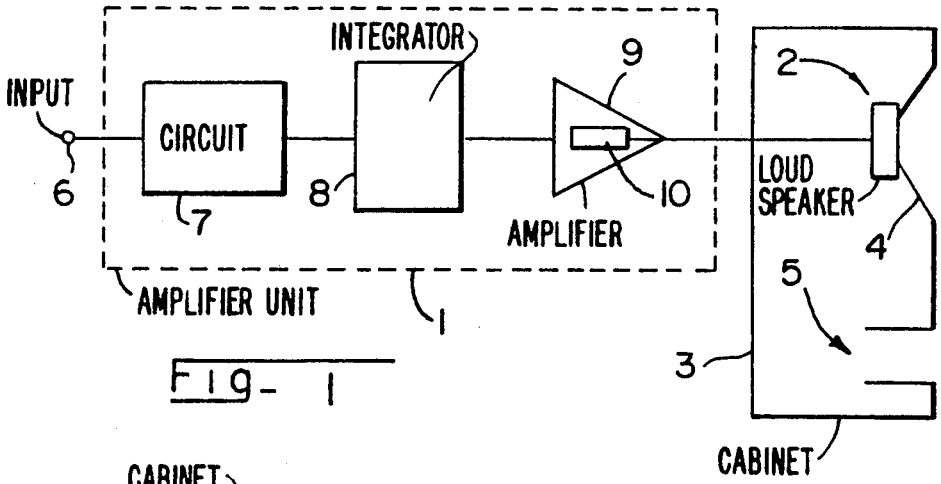
FIG. 1 schematically illustrates a first exemplary embodiment of amplifier unit according to the present invention in conjunction with a loudspeaker arranged in a cabinet or box.

Turning now to the exemplary embodiment of amplifier unit I depicted in FIG. 1, such amplifier unit 1 serves to drive an electrodynamic loudspeaker or loudspeaker element 2 arranged in a cabinet or box 3. A Helmholtz resonator here constitutes, by way of example and not limitation, the device 5 coupled with the rear or back 4 of the loudspeaker 2. The coupling between the rear 4 of the loudspeaker 2 and the coupled device 5 is perfected in conventional manner, here, for example, by the air contained in the cabinet 3.

The amplifier unit 1 comprises an input 6, a circuit means or circuit 7 for changing the characteristic of the output signal, an integrator 8 and an amplifier 9 exhibiting a negative output impedance represented by the negative resistance 10.

Figure 2:
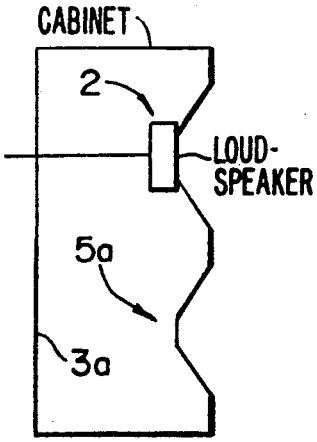
FIGS. 2, 3 and 4 respectively schematically illustrate further exemplary embodiments of cabinets or boxes.

In FIG. 2 there is depicted a further example of a cabinet or box 3*a* in which there is arranged a device or coupled device 5*a*. Here, a non-driven diaphragm serves as the device 5*a*, and which likewise is coupled by the air within the cabinet or box 3*a* with the loudspeaker or loudspeaker element 2.

Figure 3:
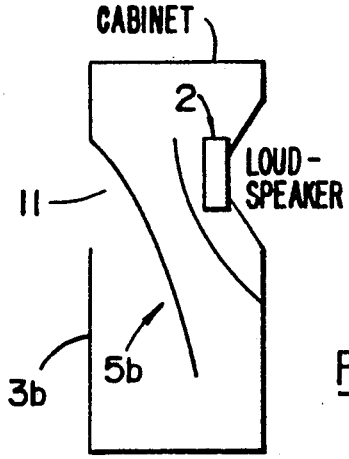

FIG. 3 illustrates another example of a cabinet or box 3*b* in which there is arranged a device or coupled device 5*b*. Here, a folded channel merging with an opening or port 11 serves as the device 5*b*.

Figure 4:
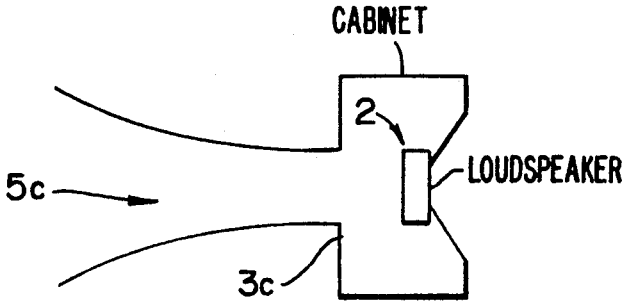

FIG. 4 depicts a still further example of a cabinet or box 3*c* in which there is arranged a device or coupled device 5*c*. Here, a horn or cone serves as the device 5*c*.

Figure 5:
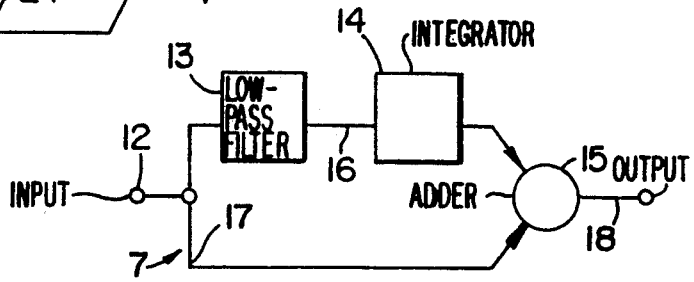

FIG. 5 illustrates an exemplary embodiment of the circuit means or circuit 7. This circuit means 7 comprises an input 12, a low-pass filter 13 of the first order, an integrator 14, an adder or summation element 15, a line or conductor 16, all connected in series with one another. Circuit means or circuit 7 further comprises a parallel line or conductor 17 which extends from the input 12 to the adder 15 and which is connected in parallel with the low-pass filter 13 and the integrator 14. The adder or summation element 15 has an output 18.

The circuit means 7 is mathematically represented by a transfer function, corresponding to the following Equation:

$$U_a/U_e = 1 + \frac{1}{sT_1(1 + sT_2)} \qquad \text{(Eq. 1)}$$

wherein, $s = j\omega$ and $j\omega$ represents the complex angular velocity or simply a frequency-dependent magnitude, and $T_2 = RC$.

Figure 6:
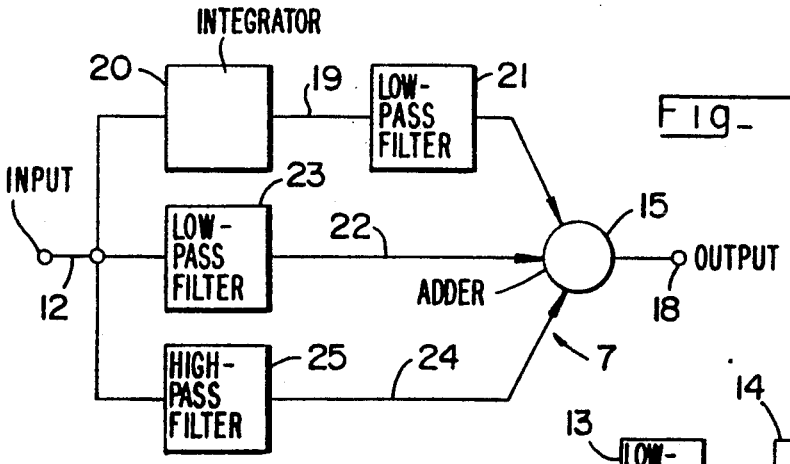
FIGS. 5, 6, 7, 8, 9 and 10 respectively schematically illustrate exemplary embodiments of circuitry which can be employed with the inventive amplifier unit.

FIG. 6 illustrates a further exemplary embodiment of the circuit means or circuit 7. An integrator 20 is connected with the input 12 by a line or conductor 19, and a low-pass filter 21 of the first order is connected with the adder or summation element 15. Furthermore, the input 12 is connected by a line or conductor 22 with a low-pass filter 23 of the first order and by a line or conductor 24 and a high-pass filter 25 of the first order with the adder 15. This adder 15 here likewise has an output 18. This circuit means 7 is mathematically represented by the Equation:

$$U_a/U_e = \frac{1}{sT_1(1 + sT_2)} + \frac{1}{(1 + sT_2)} + \frac{sT_2}{(1 + sT_2)} \qquad \text{(Eq. 2)}$$

Figure 7:
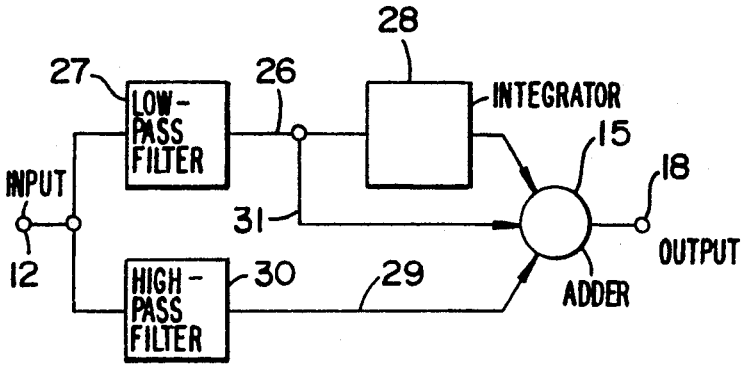

FIG. 7 illustrates a still further exemplary embodiment of the circuit means or circuit 7. With the input 12 there is connected by means of a line or conductor 26 a low-pass filter 27 of the first order, and an integrator 28 is connected with the adder or summation element 15 having an output 18. Furthermore, by means of a line or conductor 29 a high-pass filter 30 of the first order is connected with the input 12 and with the adder or summation element 15. A further line or conductor 31 is connected between the low-pass filter 27 and the integrator 28 and leads to the adder 15. This circuit means 7 is mathematically represented by the same Equation 2 previously used to represent the circuit means of FIG. 6.

Figure 8:
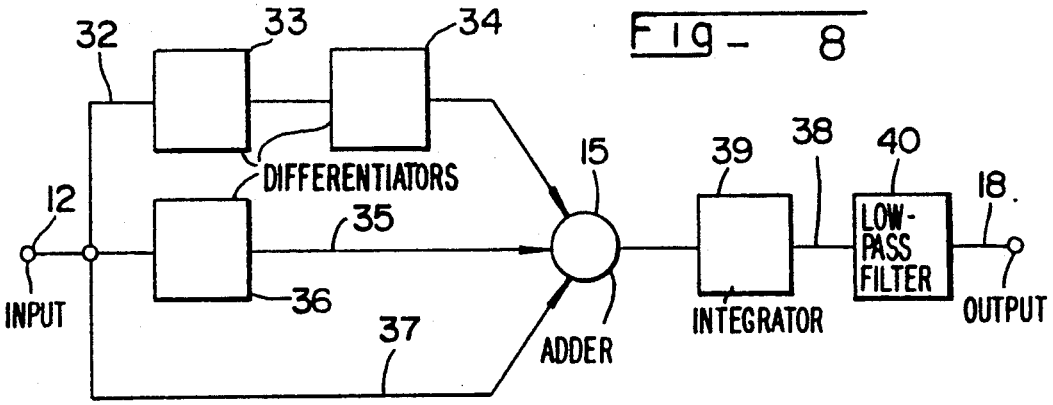

FIG. 8 illustrates yet a further exemplary embodiment of the circuit means or circuit 7. At the input 12 there are connected by means of a line or conductor 32 two differentiators or differentiating elements 33 and 34 and by means of a line or conductor 35 a differentiator or differentiating element 36. Additionally, the lines 32 and 35 as well as a further line or conductor 37 are connected with the adder or summation element 15. Between the adder 15 and the output 18 there are connected in series, by means of a line or conductor 38, an integrator 39 and a low-pass filter 40 of the first order. This circuit means 7 is mathematically represented by the Equation:

$$U_a/U_e = (1 + sT_1 + s^2T_1T_2) \times \frac{1}{sT_1} \times \frac{1}{(1 + sT_2)} \quad \text{(Eq. 3)}$$

Figure 9:
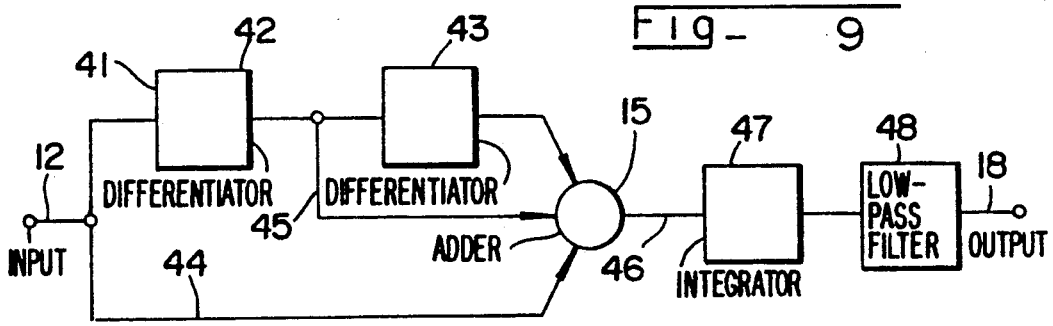

FIG. 9 illustrates yet a further exemplary embodiment of the circuit means or circuit 7. The input 12 is connected, on the one hand, by means of a line or conductor 41 with a first differentiator 42 and a second differentiator 43 and, on the other hand, by means of a line or conductor 44 with the adder or summation element 15. Between both of the differentiators 42 and 43 there is connected a further line or conductor 45 which, from that location, is directly connected with the adder or summation element 15. This adder 15 is connected by a line or conductor 46, an integrator 47 and a low-pass filter 48 with the output 18. This circuit means 7 is mathematically represented by the same Equation 3 used to represent the circuit means 7 of FIG. 8.

Figure 10:
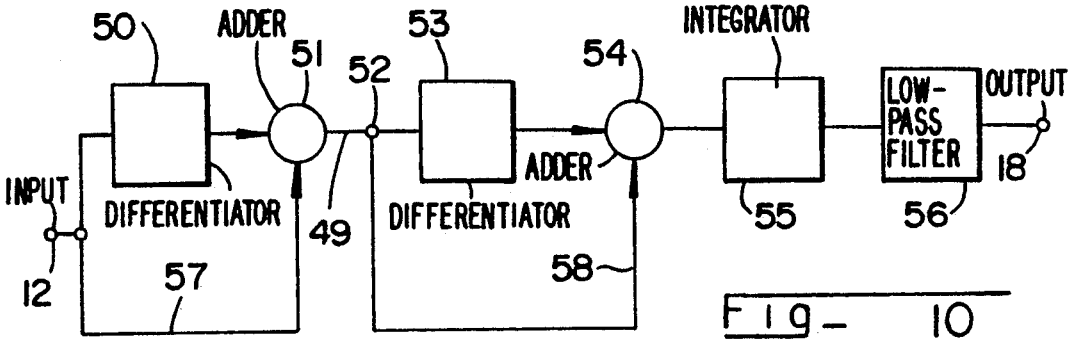

FIG. 10 illustrates another exemplary embodiment of the circuit means or circuit 7. The input 12 is connected with the output 18 by means of a line or conductor 49 in series with a first differentiator 50, a first adder 51, a node 52, a second differentiator 53, a second adder 54, an integrator 55 and a low-pass filter 56 of the first order. Furthermore, an additional line or conductor 57 extends from the input 12 to the first adder 51, and a further line or conductor 58 leads from the node 52 to the second adder 54. This circuit means 7 is mathematically represented by the following Equation:

$$U_a/U_e = (1 + sT_3)(1 + sT_4) \times \frac{1}{sT_1} \times \frac{1}{(1 + sT_2)} \quad \text{(Eq. 4)}$$

The exemplary embodiments for the circuit means 7, as illustrated in FIGS. 7 to 10, are thus relatively simple filters which those skilled in the art can readily construct, and thus, need not be here further described. Also, the person skilled in this technology readily recognizes that an integrator also can be constructed as a low-pass filter or can be considered as such. In corresponding fashion two successive low-pass filters of the first order then also can be constructed as a low-pass filter of the second order. The same also holds true for the differentiators which can be designed as high-pass filters.

Figure 11:
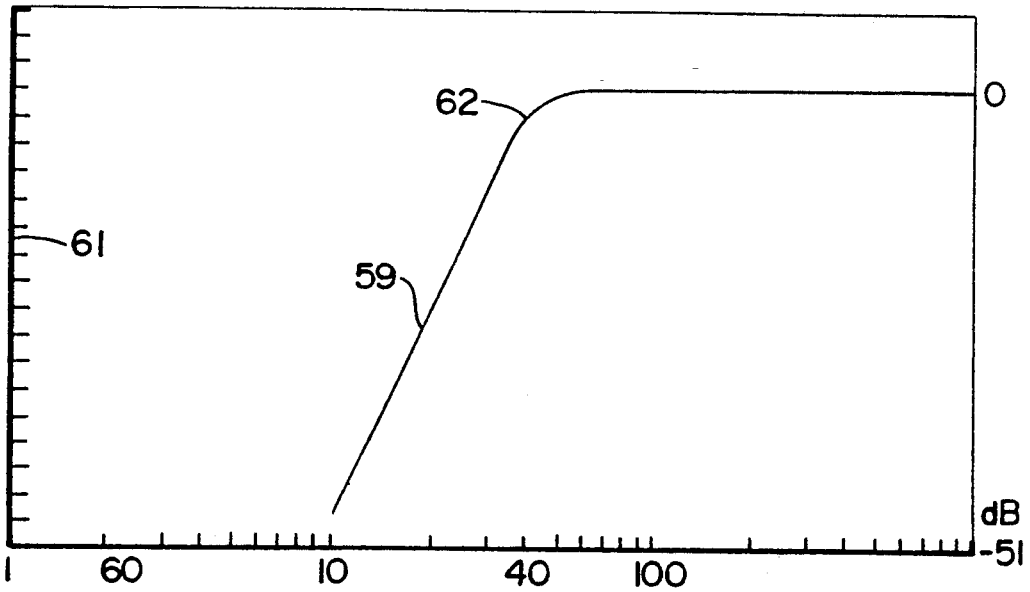
Fig- 11 PRIOR ART
FIGS. 11, 12 and a schematically illustrate respective characteristics for a loudspeaker equipped with an amplifier unit according to the prior art.

FIG. 11 illustrates a frequency response 59 as the same is valid for a known bass reflex loudspeaker. Frequency values are logarithmically plotted in Hz along the abscissa 60. Along the ordinate 61 there are plotted amplitude values in decibels. There also will be recognized the so-called 3dB-point, indicated by reference numeral 62. This means that the amplitude of a signal having a frequency of 40 Hz is reduced by 3dB in relation to a signal having a multiple frequency.

Figure 12:
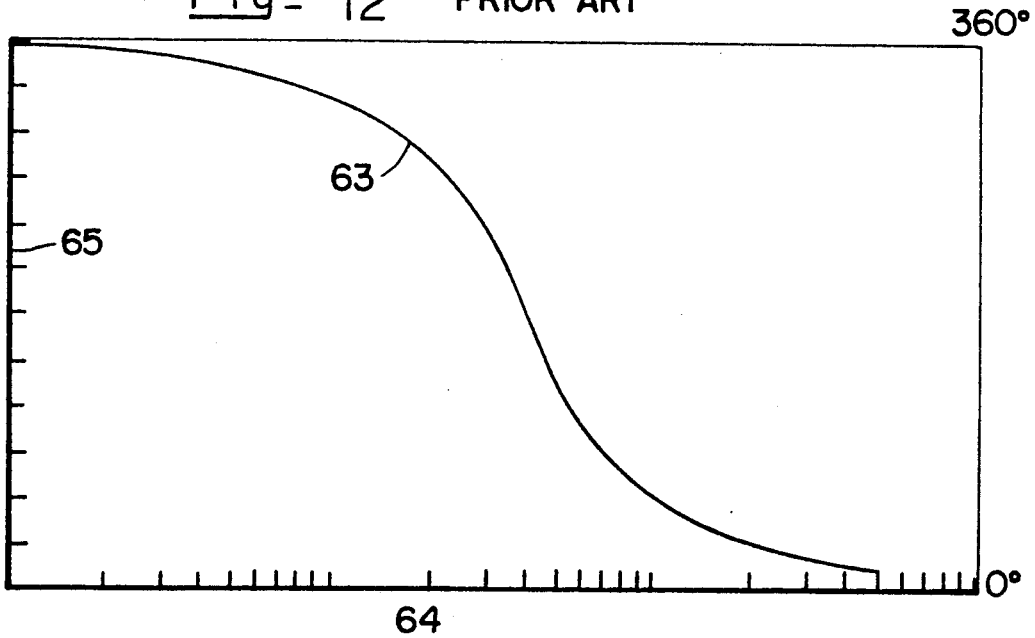
Fig- 12 PRIOR ART

FIG. 12 illustrates the phase shift 63 for signals which are reproduced in the aforementioned bass reflex loudspeaker. Here, just like in FIG. 11, frequency values are plotted in Hz along the abscissa 64, and along the ordinate 65 there are plotted values for the phase difference or shift from 0° to 360°. For instance, there will be recognized that a signal having a frequency of 40 Hz experiences a 180° phase shift.

Figure 13:
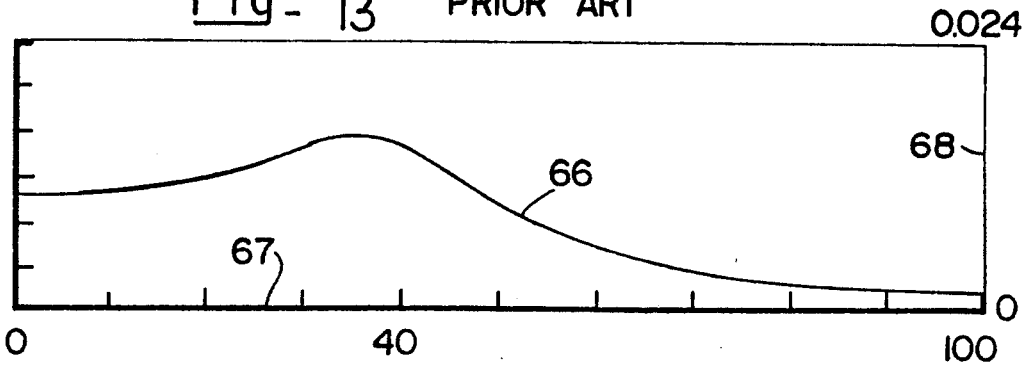
Fig- 13 PRIOR ART

FIG. 13 illustrates the transit times 66 of signals having different frequencies in the aforementioned known bass reflex loudspeaker. Frequency values are plotted in Hz along the abscissa 67, and along the ordinate 68 there are plotted values of time or time differences in seconds. There will be recognized, for instance, that a signal having a frequency of 40 Hz experiences a delay of about 0.015 seconds.

Figure 14:
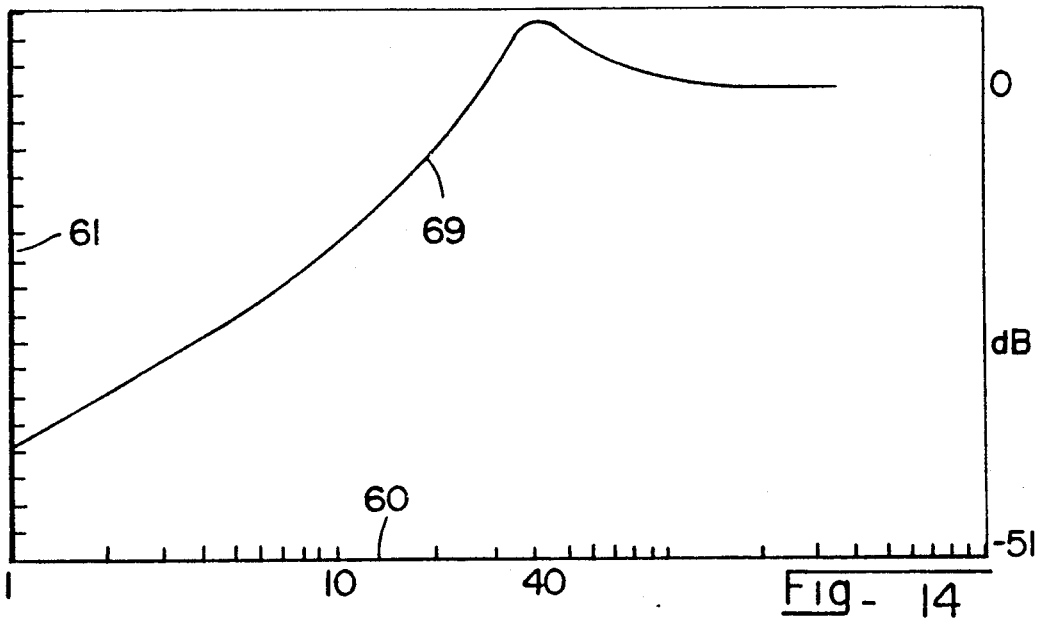
FIGS. 14, 15 and 16 schematically illustrate respective characteristics for a loudspeaker equipped with a further construction of amplifier unit.

FIG. 14 illustrates, like FIG. 11, a frequency response 69 for a cabinet or box containing a Helmholtz resonator and a loudspeaker or loudspeaker element connected to an amplifier exhibiting negative output impedance. There will be seen that at a frequency of 40Hz there are obtained maximum amplitudes.

Figure 15:
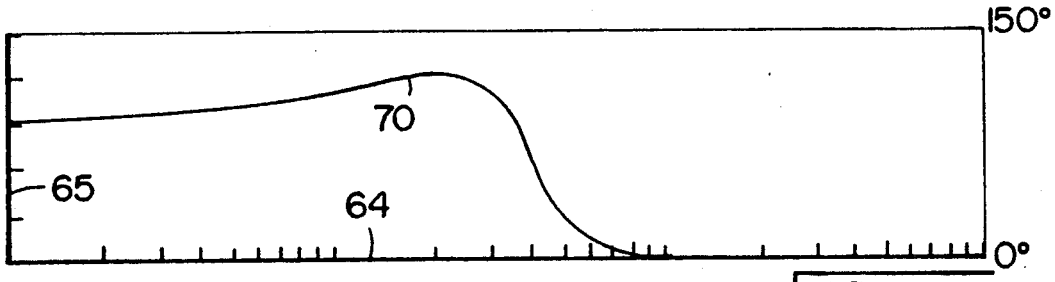

FIG. 15 illustrates, like FIG. 12, the phase shift 70 for signals emanating from a loudspeaker having a cabinet or box as considered with respect to FIG. 14.

Figure 16:
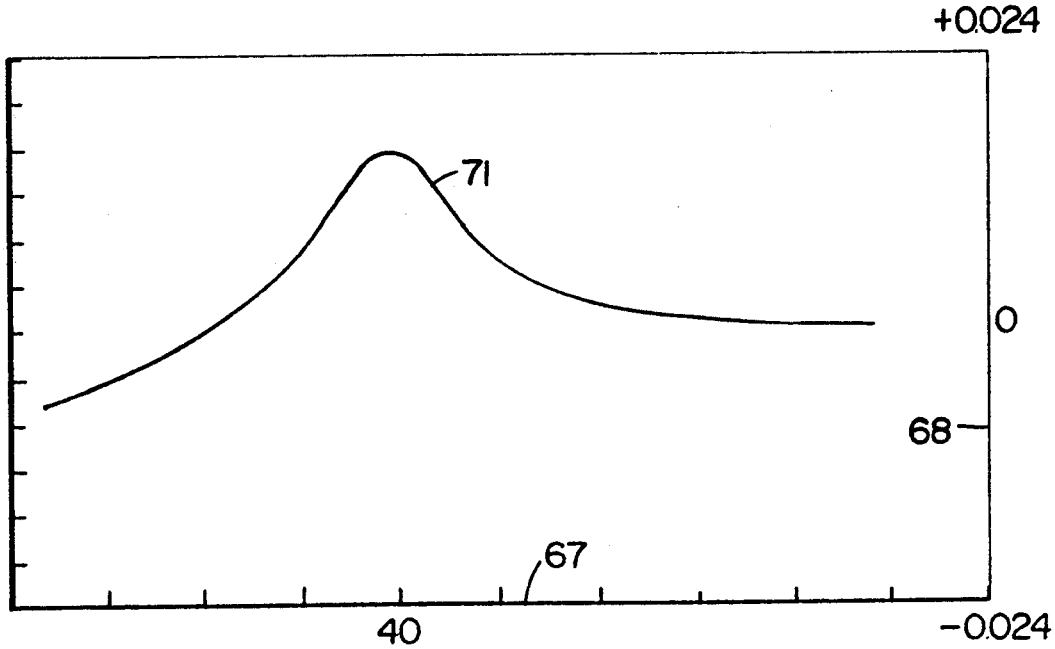

FIG. 16 illustrates, like FIG. 13, the transit times 71 of signals having different frequencies as such originate from a loudspeaker having a cabinet or box as is valid for FIGS. 14 and 15. Here, there will be recognized that, for this example, the greatest transit time prevails for a signal having a frequency of about 40 Hz.

Figure 17:
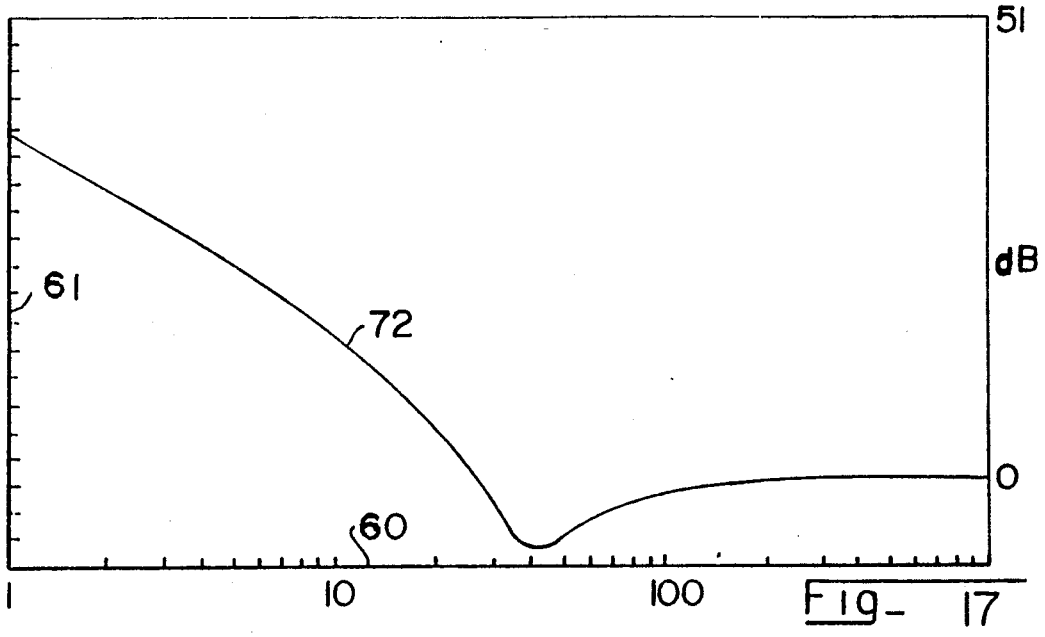
FIGS. 17, 18 and 19 schematically illustrate respective characteristics for a part of the inventive amplifier unit.
Figure 18:
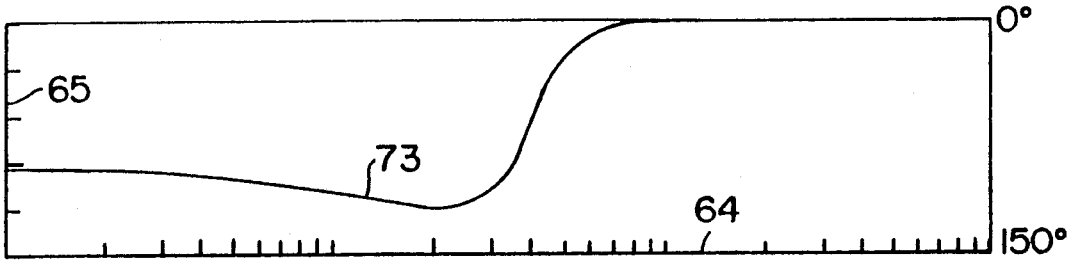
Figure 19:
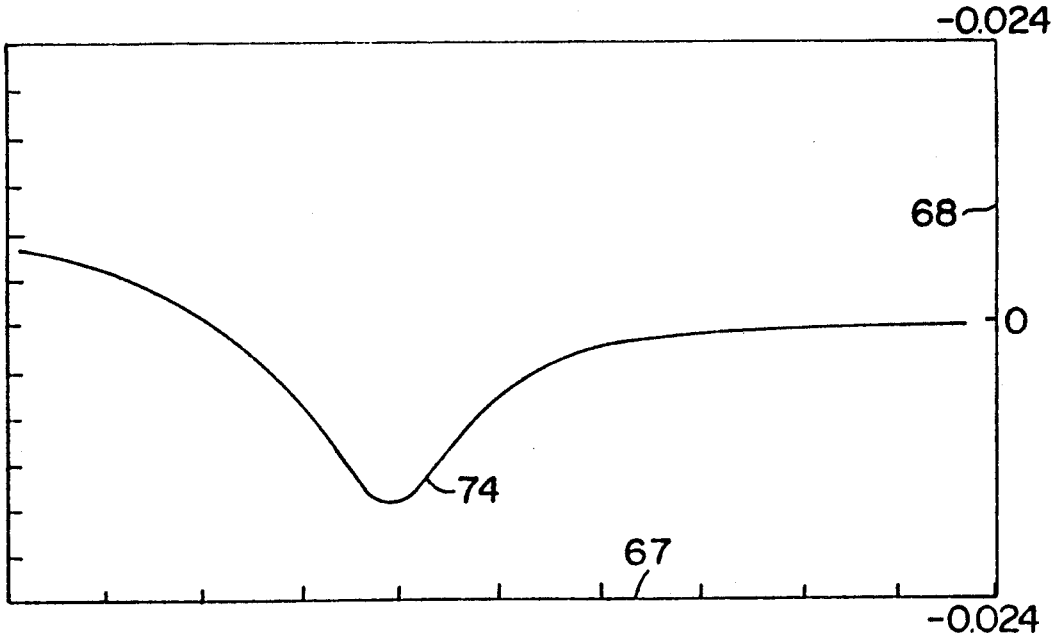

FIGS. 17, 18 and 19 depict respective characteristics as such are valid for a circuit means or circuit 7 for changing the characteristic of an output signal. In contrast thereto, FIGS. 11, 12 and 13 depict respective characteristics according to the prior art and FIGS. 14, 15 and 16 depict respective characteristics for the combination of a loudspeaker with a bass reflex cabinet or box and an amplifier exhibiting negative output impedance, as such is not part of the prior art since the same has never been carried out. This combination only constitutes a step in the development of the inventive solution, which to enhance the understanding of the invention has been illustrated, but in reality has never been performed because it exhibits significant defects as concerns frequency response, phase response and time behavior.

FIG. 17 illustrates as characteristic a frequency response 72 which is inverse to the frequency response 69 of FIG. 14. Just as was the case for FIGS. 11 and 14, frequency values are likewise here plotted along the abscissa 60 and amplitude values along the ordinate 61.

FIG. 18 illustrates as characteristic a phase shift 73 which is inverse to the phase shift depicted in FIG. 15. Frequency values plotted along the abscissa 64 are the same as in FIG. 15 and the values for the phase shift plotted along the ordinate 65 extend from 0° to −150°.

FIG. 19 illustrates as characteristic the transit times 74 which are inverse to the corresponding showing of the transit times 71 appearing in FIG. 16. The same values of the frequency are plotted along the abscissa 67 and the same values for the transit times are plotted along the ordinate 68.

Figure 20:
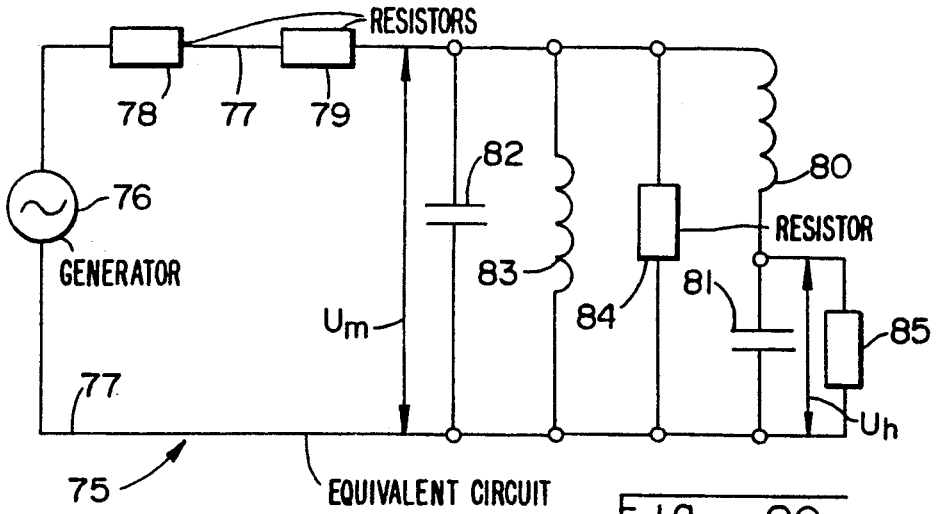
FIG. 20 illustrates an equivalent circuit for the amplifier unit provided with a loudspeaker and cabinet or box.

Turning attention now to FIG. 20, there is depicted an equivalent circuit 75 for the amplifier unit I together with the loudspeaker or loudspeaker element 2, the cabinet or box 3 and the coupled device 5, as depicted and previously considered with reference to FIG. 1. The manner in which there is derived such equivalent circuit is well known to the person skilled in this art, as, for example, disclosed in the article entitled "Vented-Box Loudspeaker Systems", authored by Richard H. Small, appearing in the Journal of the Audio Engineering Society, June 1973, and the article entitled "Loudspeakers in Vented Boxes", authored by A. A. Thiele, appearing in the Journal of the Audio Engineering Society, May 1971, for an impedance equivalent circuit and for a motional equivalent circuit.

The equivalent circuit 75 of FIG. 20 is a motional equivalent circuit. In such equivalent circuit 75 electrical potentials correspond to movements or velocities, for example, the diaphragm of the loudspeaker or the air which is moved by such diaphragm. This equivalent circuit 75 has been simplified in known manner in that, the acoustical part and the mechanical part of a general equivalent circuit known from the aforementioned publications, have both been computed into the electrical part. Accordingly, there will be recognized only a generator 76 connected in series by a line or conductor 77 with resistors or resistances 78 and 79, with an inductance 80 and with a capacitor or capacitance 81. Furthermore, a capacitor or capacitance 82, an inductance 83 and a resistor or resistance 84 are connected in parallel with the generator 76 provided with the resistances 78 and 79.

The resistance 78 corresponds to the internal resistance of the generator 76, the resistance 79 corresponds to the resistance of the voice coil in the loudspeaker, the inductance 80 corresponds to the acoustical mobility of the air cushion in the cabinet or box or the reciprocal value of the acoustical spring constant of the air behind the diaphragm, the capacitance 81 corresponds to the acoustical mass of the air column in the tube of the Helmholtz resonator, the capacitance 82 corresponds to all of the remaining masses of the system with the exception of the above-described masses, the inductance 83 corresponds to the sum of the remaining mobilities or the reciprocal value of all of the mechanical and acoustical spring forces in the system, and the resistance 84 corresponds to the sum of the reciprocal values of the losses, such as due to mechanical friction, heat and so forth, in the system including radiation impedances of the diaphragm. Furthermore, a resistor or resistance 85 is connected parallel to the capacitor or capacitance 81 and which corresponds to the reciprocal value of the acoustical losses inclusive of the radiation impedances in the Helmholtz resonator. For an amplifier unit 1 exhibiting negative output impedance there is thus valid that the sum of the resistances of the resistors or resistances 78 and 79 must amount to null.

All of the exemplary embodiments of circuit means or circuits 7 for altering the output signal, as illustrated in FIGS. 5 to 10, alter an input signal, as inputted at the inputs 6 or 12, according to the characteristics 72, 73 and 74 as depicted in FIGS. 17, 18 and 19, respectively. The thus altered signal is then delivered to the integrator 8 where it is integrated as a function of time. The frequency response of such an integrator is well known and corresponds to a straight line which descends with increasing frequency, with logarithmic representation of the frequency. Thereafter, the signal is delivered to the amplifier 9 which amplifies such signal and imparts thereto the characteristic of a negative impedance. The frequency response of this amplifier 9 together with the subsequently connected loudspeaker 2 containing the cabinet or box 3, according to physical principles, is inverse to the frequency response of the integrator 8, which is the reason for connecting such forwardly thereof.

The entire signal radiated by the cabinet or box 3 then again possesses an ideal frequency response. In other words, all negative effects experienced by the electrical and acoustical signal in the loudspeaker 2 and in the cabinet 3 containing the coupled device 5, are pre-compensated by the circuit means 7, the integrator 8 and the negative impedance characteristic of the amplifier 9. Additionally, there are determined for the design of the circuit means 7 the characteristic concerning all elements of the amplifier unit 1, with the exception of the circuit means 7, and the loudspeaker 2 and compared with the ideal characteristic. As a result, there are formed the characteristics 69, 70 and 71. Then there are produced and in contrast to ideal linear characteristics, the inverse characteristics 72, 73 and 74. By means of the latter there are already compensated spurious effects which arise in the loudspeaker 2. It is also important that the effect of the negative impedance is not limited by further means or expedients to a predetermined frequency range. The negative impedance must be effective without disturbance throughout a wide frequency range, for example, at least up to two octaves above the resonance frequency of the loudspeaker.

It is particularly advantageous to determine the circuit means 7 starting from a first characteristic 69, 70 and 71 which is not derived experimentally, rather from theoretical considerations, for example, starting with an electrical equivalent circuit as such is generally known for a loudspeaker containing a bass reflex cabinet and depicted in FIG. 20. As concerns the here proposed prerequisite that the loudspeaker is driven by an amplifier unit exhibiting negative output impedance, in such equivalent circuit the resistance of the voice coil and the internal resistance of the driving generator which are connected in series with one another, must cancel one another or when added together must always amount to null. Thus, for the entire arrangement as depicted in FIG. 1, but without the circuit 7, there is obtained a transfer function which is expressed by the following Equation:

$$U_{tot} = \frac{\frac{sL}{R}(1 + sCR)}{1 + \frac{sL}{R} + s^2LC} \times U_g \qquad \text{(Eq. 5)}$$

wherein, $s = j\omega$ resulting in a frequency dependent expression, where the angular velocity $\omega = 2\pi f$;

$L$ = acoustical mobility in the Helmholtz resonator;

$R$ = losses in the Helmholtz resonator;

$C$ = masses in the Helmholtz resonator;

$U_{tot} = U_m - U_h$, wherein, $U_m$ represents the diaphragm velocity;

$U_h$ represents the air velocity in the Helmholtz resonator; and $U_g$ represents the generator voltage.

From the above transfer function which is derived from the equivalent circuit 75 exhibiting negative output impedance for the generator 76, there then can be easily also derived the transfer function for a circuit 7. It corresponds to the inverse transfer function and is expressed by the following Equation:

$$U_{g'} = U_g \frac{1}{\frac{sL}{R}(1 + sCR)} + 1 \qquad \text{(Eq. 6)}$$

In this regard it is known that the expression $$\frac{1}{\frac{sL}{R}} = \frac{1}{sT_1}$$

constitutes the transfer function of an integrator and that the expression $$\frac{1}{(1 + sCR)} = \frac{1}{(1 + sT_2)}$$

constitues the transfer function of a low-pass filter. Thus, there can be easily derived the mathematical equations, which have been set forth for the circuits of FIGS. 5 to 10, by known mathematical transformations and extensions.

Equally, the circuit 7 for changing the characteristic of the output signal can be designed with conventional digital operating means, and thus, the characteristics also can be digitally formed.

While there are shown and described present preferred embodiments of the invention, it is distinctly to be understood the invention is not limited thereto, but may be otherwise variously embodied and practiced within the scope of the following claims.

What is claimed is:

1. An amplifier unit for driving an electrodynamic loudspeaker arranged in a cabinet along with a device which is coupled with the rear of the electrodynamic loudspeaker and which adds acoustic energy in a limited frequency range with the same polarity to that energy which is delivered form the front of the electrodynamic loudspeaker, the improvement which comprises:

the amplifier unit exhibiting a negative output impedance;

an amplifier provided for the amplifier unit;

an integrator provided for the amplifier unit;

the electrodynamic loudspeaker together with the coupled device, the amplifier and the integrator delivering an output signal exhibiting a first characteristic; and circuit means provided for the amplifier unit for altering an input signal in accordance with a second characteristic which is at least approximately inverse to the first characteristic, wherein the amplifier exhibits a negative output impedance and is constructed such that the negative output impedance is effective at least over two octaves above resonance frequency of the electrodynamic loudspeaker.

2. The amplifier unit according to claim 1, wherein: the circuit means comprises filter means.

3. The amplifier unit according to claim 1, wherein: the first characteristic is determined by computation employing an equivalent circuit of the electrodynamic loudspeaker equipped with the cabinet, the coupled device and the amplifier.

4. The amplifier unit according to claim 1, wherein: the circuit means is connected in series with the integrator and the amplifier.

5. The combination which comprises an electrodynamic loudspeaker having a rear and a front and an amplifier unit for driving the electrodynamic loudspeaker;

a cabinet within which there is arranged the electrodynamic loudspeaker;

a device provided for the electrodynamic loudspeaker;

the device being coupled with the rear of the electrodynamic loudspeaker and unipolarly adding acoustic energy in a limited frequency range to energy which is delivered from the front of the electrodynamic loudspeaker;

the amplifier unit exhibiting a negative output impedance;

an amplifier unit exhibiting a negative output impedance;

an amplifier provided for the amplifier unit;

an integrator provided for the amplifier unit;

the electrodynamic loudspeaker together with the device, the amplifier and the integrator delivering an output signal exhibiting a first characteristic; and circuit means provided for the amplifier unit for altering an input signal in accordance with a second characteristic which is at least approximately inverse to the first characteristic, wherein the amplifier exhibits a negative output impedance and is constructed such that the negative output impedance is effective at least over two octaves above resonance frequency of the electrodynamic loudspeaker.

* * * * *